US007357389B2

(12) United States Patent
Landwehr

(10) Patent No.: US 7,357,389 B2
(45) Date of Patent: Apr. 15, 2008

(54) TRANSPORT DEVICE COMPRISING A BRANCH FOR TRANSPORTING SHEETS

(75) Inventor: Martin Landwehr, Paderborn (DE)

(73) Assignee: Wincor Nixdorf International GmbH (DE)

( * ) Notice: Subject to any disclaimer, the term of this patent is extended or adjusted under 35 U.S.C. 154(b) by 21 days.

(21) Appl. No.: 10/575,303

(22) PCT Filed: Oct. 2, 2004

(86) PCT No.: PCT/DE2004/002206

§ 371 (c)(1),
(2), (4) Date: Apr. 11, 2006

(87) PCT Pub. No.: WO2005/040019

PCT Pub. Date: May 6, 2005

(65) Prior Publication Data

US 2007/0035084 A1 Feb. 15, 2007

(30) Foreign Application Priority Data

Oct. 14, 2003 (DE) ..... 103 47 767

(51) Int. Cl.
*B65H 29/12* (2006.01)

(52) U.S. Cl. ..... 271/184; 414/790.7; 198/817; 209/534

(58) Field of Classification Search ..... 271/184, 271/69, 177, 225; 198/586, 604, 620, 817; 414/790.7; 209/534
See application file for complete search history.

(56) References Cited

U.S. PATENT DOCUMENTS 4,417,137 A 11/1983 Lundblad
4,436,297 A * 3/1984 Chandhoke ..... 271/3.05
4,709,820 A * 12/1987 Jenkins et al. ..... 209/534
4,832,328 A * 5/1989 Graham ..... 271/35
4,856,768 A * 8/1989 Hiroki et al. ..... 271/186

(Continued)

FOREIGN PATENT DOCUMENTS

DE 565034 C 11/1932

(Continued)

OTHER PUBLICATIONS

International Search Report for PCT/DE2004/002206, dated Jan. 24, 2005 ISA/EP.

*Primary Examiner*—Douglas A Hess
(74) *Attorney, Agent, or Firm*—Harness, Dickey & Pierce, P.L.C.

(57) ABSTRACT

The invention is concerned with a transport device for sheets, with which branching of the transport path can be implemented in a manner which is simple and not susceptible to faults. This object is achieved by a transport device which comprises a first belt transport unit and a second belt transport unit, the second belt transport unit being arranged transversely with respect to the first belt transport unit. Between the belts of the first belt transport unit and of the second belt transport unit, a transport path for valuable documents or bank notes is formed in each case. At the end of the transport path, the leading edge of a sheet which is transported along the transport path of the first belt transport unit strikes the upper transverse belt of the second belt transport unit and is deflected by the belt in such a way that it is now transported along the transport path of the second belt transport unit. Depending on the direction of rotation of the rolls which are used to guide and to drive the belts, the sheet can be deflected into the left or right section of the second belt transport unit, so that a diverter function is made possible hereby without separate drives or control means being necessary. Furthermore, by driving the direction of rotation of the rolls, a sheet stack can be formed within the transport path of the second belt transport unit.

9 Claims, 3 Drawing Sheets

U.S. PATENT DOCUMENTS

Figure 1:
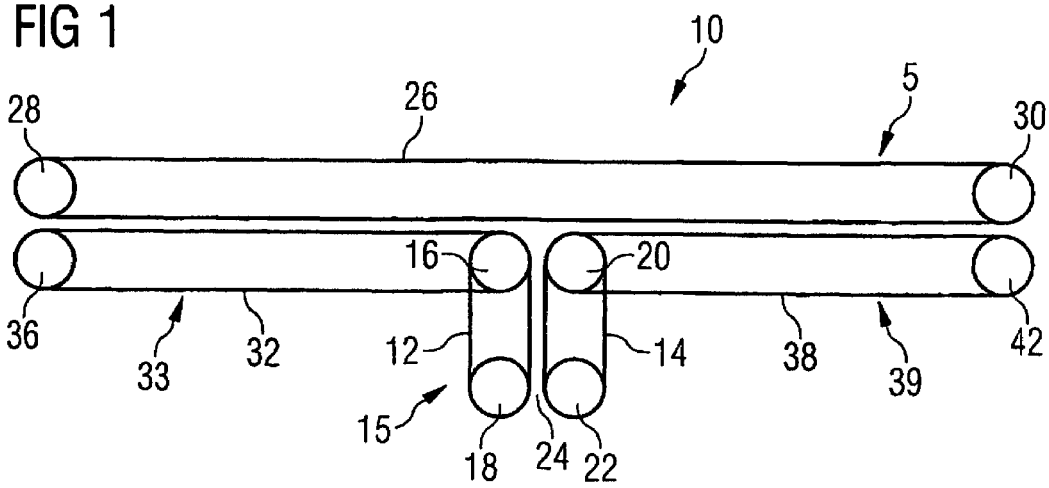

| | | | | | |
|---|---|---|---|---|---|
| 4,866,254 | A * | 9/1989 | Okayama et al. | 235/379 |
| 5,536,002 | A * | 7/1996 | Yoshida et al. | 271/264 |
| 5,979,891 | A * | 11/1999 | Roux | 271/225 |
| 6,550,621 | B2 * | 4/2003 | Fukatsu et al. | 209/534 |
| 6,644,651 | B2 * | 11/2003 | Allsup | 271/184 |
| 6,659,258 | B2 * | 12/2003 | Otsuka | 194/206 |

FOREIGN PATENT DOCUMENTS

| | | | |
|---|---|---|---|
| DE | 2816371 | C2 | 10/1979 |
| DE | 3227165 | C2 | 2/1983 |
| DE | 3409241 | A1 | 9/1984 |
| DE | 10103120 | C1 | 7/2002 |

* cited by examiner

TRANSPORT DEVICE COMPRISING A BRANCH FOR TRANSPORTING SHEETS

The present invention relates to a transport device for transporting sheets, such as in particular valuable documents or bank notes. Transport devices of this type are used, for example, in automatic teller machines and automatic safe deposit machines in order to transport bank notes or check forms. In addition to rectilinear transport, a branch in the transport path is often needed, for example if bank notes are to be deposited in one or more cassettes that are available or if bank notes whose quality is inadequate or whose authenticity is questionable have to be separated out. For such branches, use is normally made of diverters which are actuated by drive devices. However, such diverters are normally of complicated construction and susceptible to faults.

The invention is based on the object of specifying a transport device for sheets with which a branch in the transport path can be implemented in a manner that is simple and not susceptible to faults.

This object is achieved by a transport device which comprises a first belt transport unit and a second belt transport unit, the second belt transport unit being arranged transversely with respect to the first belt transport unit. Between the belts of the first belt transport unit and of the second belt transport unit, a transport path for valuable documents or bank notes is formed in each case. At the end of the transport path, the leading edge of a sheet which is transported along the transport path of the first belt transport unit strikes the upper transverse belt of the second belt transport unit and is deflected by the belt in such a way that it is now transported along the transport path of the second belt transport unit. Depending on the direction of rotation of the rolls which are used to guide and to drive the belts, the sheet can be deflected into the left or right section of the second belt transport unit, so that a diverter function is made possible hereby without separate drives or control means being necessary. Furthermore, by driving the direction of rotation of the rolls, a sheet stack can be formed within the transport path of the second belt transport unit by successive sheets being transferred from the first belt transport unit into the second belt transport unit and the new sheet being deposited under the sheet stack already formed in the first or second section of the second belt transport unit.

Figure 2:
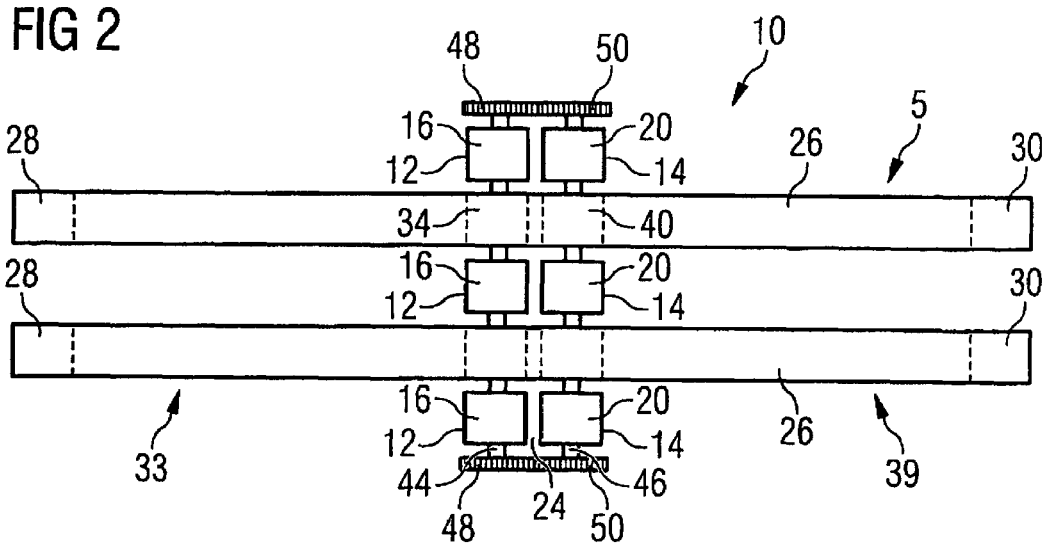
Figure 4:
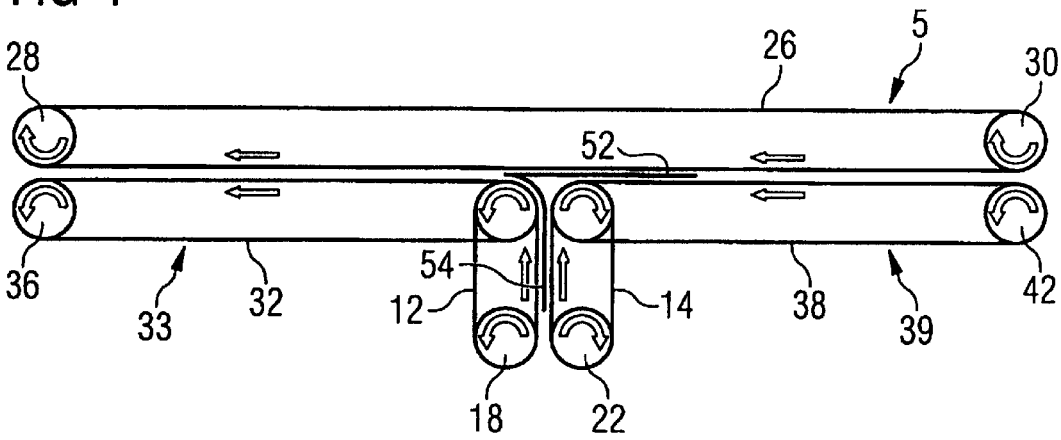
Figure 5:
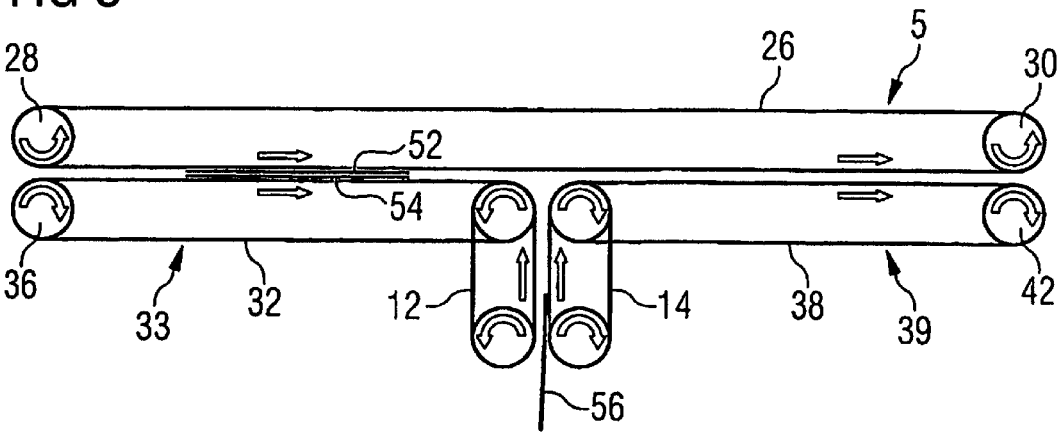
Figure 6:
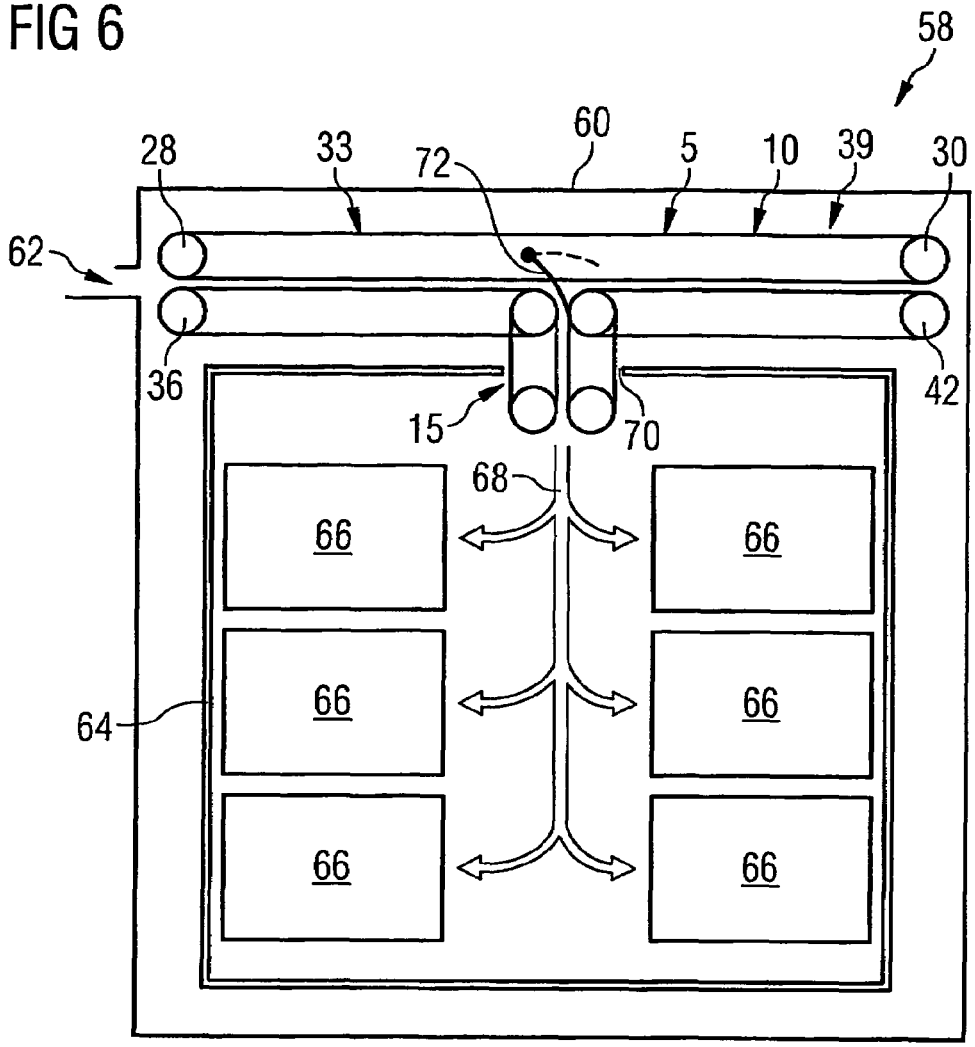

Further features and advantages of the solution according to the invention emerge from the following description which, in conjunction with the appended drawings, explains the invention by using an exemplary embodiment. In the drawings:

FIG. 1 shows a schematic side view of a transport device according to the invention, FIG. 2 shows a plan view of the transport device from FIG. 1, FIGS. 3 to 5 show a sequence of instantaneous recordings of the transport device from FIG. 1 during the formation of a sheet stack, and FIG. 6 shows a schematic sectional illustration of a device for paying bank notes in and out, which comprises the transport device from FIG. 1.

A transport device 10 according to the invention is illustrated schematically in a side view in FIG. 1 and in a plan view in FIG. 2. The transport device 10 comprises a first belt transport unit 15, which is preferably formed from three endless belts 12 and three endless belts 14. The belts 12 are tensioned between rolls 16 and rolls 18, and the belts 14 are tensioned between rolls 20 and rolls 22. As a result of the rotational movement of the rolls, the belts are driven, the direction of rotation of the rolls determining the transport direction of the belts.

Formed between the belts 12 and the belts 14 is a transport path 24 for a bank note, which path is vertical in the illustration of FIG. 1. The belts 12, 14 and all the further belts mentioned in the following text are fabricated from an elastic material, so that the belts 12, 14 rest on one another and likewise a valuable document or a bank note can be guided between the belts 12, 14. The device further comprises a second belt transport unit 5, which is preferably formed from two belts 26 and 2 pairs of belts 32 and 38 and runs transversely with respect to the first belt transport unit 15. The two endless belts 26 are tensioned between the rolls 28 and rolls 30.

The two endless belts 32 are tensioned between the rolls 34 and rolls 36. In FIG. 2, the rolls 34 are hidden by the belts 26 and therefore shown dashed. The two endless belts 38 are tensioned between the rolls 40 and rolls 42. In FIG. 2, the rolls 40 are likewise covered by the third belts 26 and therefore shown dashed.

The belts 32, together with the opposite section of the belt 26, form a first section 33 of the second belt transport unit, which is bounded by an outer end in the region of the roll 36 and by an inner end in the region of the roll 34. In the same way, the belts 38, together with the opposite section of the belt 26, form the second section 39 of the second belt transport unit.

The rolls 16 and the rolls 34 are arranged on a common shaft 44. The rolls 20 and the rolls 40 are arranged on a common shaft 46. The shafts 44 and 46 are coupled to each other via coupling gears 48 and 50 which are arranged at the respective ends of the shaft 44 and 46, respectively. The rolls 16 are firmly mounted on the first shaft 44 so as to rotate with it, and the rolls 20 are firmly mounted on the second shaft 46 so as to rotate with it. The first belt transport unit 15 is driven by the fact that the first and/or second shaft 44, 46 are/is driven. For this purpose, an individual drive can be provided (not shown), in particular if the first belt transport unit 15 is to transport in both directions (upward and downward). In this case, the rolls 34 and the rolls 40 are freely rotatably mounted on the first shaft 44 and on the second shaft 46, respectively.

If, in the first belt transport unit 15, transport in only one direction is envisaged, one of the rolls 34 and one of the rolls 40 can be coupled to the associated shaft 44 and 46 via a freewheel in such a way that it can drive the associated shaft only in the direction of rotation which corresponds to the envisaged transport direction of the first belt transport unit 15. In this case, no individual drive is needed for the first belt transport unit 15; instead the first belt transport unit 15 is driven by the second belt transport unit 33, 39 via the belts 32 and the belts 38 via the aforementioned freewheels.

Figure 3:
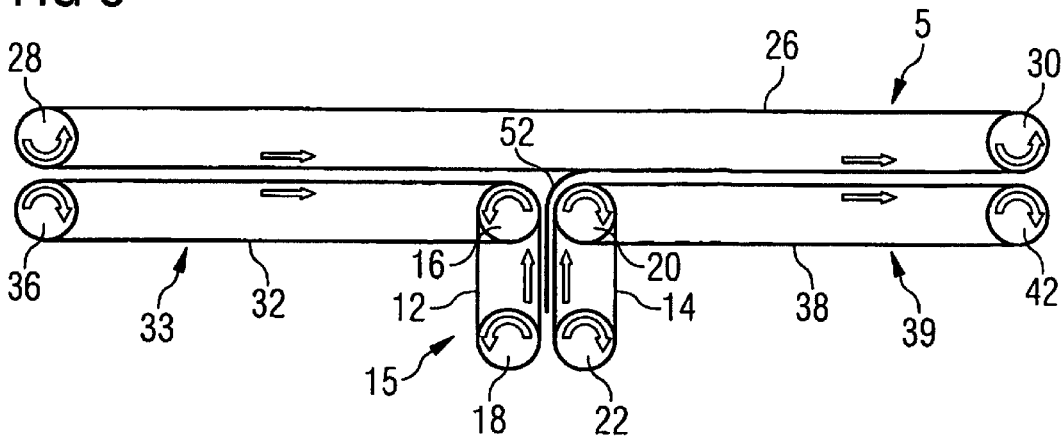

In the following, the functioning of the transport device 10 will be described with reference to FIGS. 3 to 5. FIGS. 3 to 5 are three successive instantaneous recordings during the formation of a sheet stack in the device. In the instantaneous recordings, the directions of rotation of the rolls and the running directions of the belts are identified by adjacent arrows. The drives of the first belt transport unit 15 and of the second belt transport unit 5 are driven by a control unit (not shown) in such a way that the following transport behavior results for the valuable documents or bank notes to be transported.

In the instantaneous recording of FIG. 3, a first sheet 52 is being transported upward in the transport path 24 of the first belt transport unit 15. For reasons of clarity, all the transport paths are illustrated highly enlarged in the figures. In actual fact, the belts rest on one another; however, because of the elasticity of the belts, a sheet can be guided between the belts. The leading end of the first sheet 52 has already struck the third belt 26 and, on account of the running direction of the latter, is drawn along and thus bent over to the right, while the rear part of the first sheet 52 continues to be guided after it in the first belt transport unit 15. Thus, the first sheet 52 is introduced with its leading end into the second section 39 of the second belt transport unit 5. The running direction of the rolls and belts is maintained until the first sheet 52 is located completely in the second section 39 of the second belt transport unit 5.

The running direction of the belts 26, 32, 38 of the second belt transport unit 5 is then reversed by reversing the direction of rotation of the rolls 28, 30; 36, 16; 20, 42. This leads to the first sheet 52, as shown in FIG. 4, being transported in the direction of the first section 33 of the second belt transport unit 5.

At the same time, a second sheet 54 is transported upward in the first belt transport unit 15 (FIG. 4). The reversal of the transport direction in the second belt transport unit 5 and the feeding of the second sheet 54 are coordinated with each other in time in such a way that the first and the second sheet 52, 54 meet each other in the intermediate region between the first and the second section 33, 39 of the second belt transport unit 5 and are introduced jointly into the first section 33 of the second belt transport unit 5, as shown in FIG. 4. The two sheets 52, 54 lie above each another and the transport is continued until the sheet stack 52, 54 is located completely in the first section 33 of the second belt transport unit 5.

The transport direction in the second belt transport unit 5, that is to say of the belts 26, 32 and 38, is then reversed again, so that the sheet stack 52, 54 is moved to the right again, as shown in the instantaneous recording of FIG. 5. At the same time, a third sheet 56 is transported upward in the first belt transport unit 15 (see FIG. 5). The leading ends of the sheet stack consisting of the first and second sheet 52, 54 and of the third sheet 56 again meet one another in the intermediate region between the first and the second section 33, 39 of the second belt transport unit 5, are guided jointly into the second section 39 of the second belt transport unit 5 and thus form a sheet stack consisting of three sheets 52, 54 and 56 (not shown).

By means of the described type of control of the transport device, sheet stacks can be built up successively in the second belt transport unit 5. The roll 28 and the roll 30 can be adjusted in the vertical direction, so that the distance between the belts 26, on the one hand, and the belts 32,38, on the other hand, can be matched to a height of a sheet stack being formed.

As can be seen from the above description, the intermediate region between the first and the second section 33, 39 of the second belt transport unit 5 constitutes a branching point for sheets which are transported upward in the first belt transport unit 15. At the same time, a sheet or sheet stack can be transported from one section 33 or 38 of the second belt transport unit 5 beyond the branching point into the other section 38 or 33 of the second belt transport unit 5.

An appliance 58 for paying bank notes in or out is shown in a schematic cross-sectional view in FIG. 6. The appliance 58 has a housing 60 having an input and output point 62, at which bank notes can be paid into the appliance 58 and output from the latter, and a safe 64, in the interior of which bank note cassettes 66 are arranged.

The appliance 58 further comprises a transport device 10 as has been described above. The outer end of the first section 33 of the second belt transport unit 5 is in this case arranged at the input point 62, so that bank notes put in at the input point 62 are introduced into the first section 33 of the second belt transport unit 5 at the outer end, and bank notes which are transported beyond the outer end of the first section 33 in the second belt transport unit 5 arrive in the input and output point 62.

In the transport device 10 of the appliance 58, the first belt transport unit 15 and the second belt transport unit 5 can be driven independently of each other, and the transport devices are reversible in the case of both belt transport units 5, 15. However, while a reversal of the direction in the second belt transport unit 5 effects a displacement of a sheet stack being formed from the one section 33 into the other section 38 of the second belt transport unit, in the event of a reversal in the direction of the first belt transport unit 15, the currency notes are conveyed into the safe 64 or out of the latter.

If bank notes are to be paid out from the appliance 58, these are firstly introduced from below into the first belt transport unit 15 by a transport device 68, not specified in more detail here. From the latter, they are transported out of the safe 64 through an opening 70 in the safe 64, stacked in the second belt transport unit 5 as described in FIGS. 3 to 5 and then output at the input and output point 62.

In order to put bank notes in, these are introduced individually or in a stack via the input and output point 62 at the outer end of the first section 33 of the second belt transport unit 5 and are transported in the direction of the inner end of the latter. The device 10 of the appliance 58 has, in addition to the above described components, a guide element 72 which can be displaced from a neutral position (shown dashed in FIG. 6) into a deflected position, in which it projects into the path of a bank note located in the first or second section of the second belt transport unit 5 and deflects said bank note by its leading edge into the first belt transport unit 15. With the aid of the guide element 72, it is accordingly possible for a bank note put in at the input and output point 62 to be transported via the first section 33 of the second belt transport unit 5 and the first belt transport unit 15 into the safe 64, to be accepted there by the transport device 68 and deposited specifically in one of the storage cassettes 66.

If the first and the second section 33, 39 of the second belt transport unit 5 have a sufficient length then, by driving the direction of rotation of the rolls 28, 30; 36, 16; 20, 42 in the second belt transport unit 5, two sheet stacks can also be formed beside each other, for example one stack for bank notes that have been sorted out, whose quality is inadequate, for example, or whose authenticity is in question, and one stack with satisfactory bank notes. A reject stack of this type can be formed on the side facing away from the input and output point 62 and removed by an authorized person. A precondition for this is that both sections 33, 39 of the second belt transport unit are long enough to accommodate two bank note stacks beside each other.

LIST OF DESIGNATIONS

5 Second belt transport unit
10 Transport device
12 First belt
14 Second belt
15 First belt transport unit
16 First roll
18 Fifth roll

20 Second roll
22 Sixth roll
24 Transport gap
26 Third belt
28 Seventh roll
30 Eighth roll
32 Fourth belt
33 First section of the second belt transport unit
34 Third roll
36 Ninth roll
38 Fifth belt
39 Second section of the second belt transport unit
40 Fourth roll
42 Tenth roll
44 First shaft
46 Second shaft
48 First coupling gearwheel
50 Second coupling gearwheel
52 First sheet
54 Second sheet
56 Third sheet
58 Appliance for paying bank notes in and out
60 Housing
62 Input and output point
64 Safe
66 Bank note cassette
68 Transport device
72 Guide element

The invention claimed is:

1. A transport device (10) for transporting valuable documents, in particular bank notes and check forms, having pairs of belts comprising at least two endless belts and rotatable rolls to guide and to drive the belts, a transport path for the transport of one or more valuable documents being formed between the belts, and the transport direction of the valuable documents being determined by the direction of rotation of the rolls comprising:

a. a first belt transport unit (15) comprising at least one first belt (12) and at least one second belt (14), the first belt (12) being guided by rolls (16, 18) and the second belt (14) being guided by rolls (20, 22), and a transport path for valuable documents being formed between the belts (12, 14);

b. a second belt transport unit (5) comprising at least one first belt (26) which is guided by rolls (28, 30), and at least two second belts (32, 38), which are guided by rolls (36, 34) and rolls (40, 42), the belt (32) forming with the belt (26) a first belt transport section (33), and the belt (38) forming with the belt (26) a second belt transport section (39), and a transport path for valuable documents being formed between the belts of the first and second belt transport section (33, 39);

c. the second belt transport unit (5) being arranged transversely with respect to the first belt transport unit (15); and d. a valuable document which is transported along the transport path of the first belt transport unit (15) in the direction of the second belt transport unit and striking the belt (26) with its leading edge being transferred into the first belt transport section (33) or the second belt transport section (39), depending on the direction of rotation of the rolls (28, 30; 36, 34; 40, 42), wherein an adjustable guide element (72) is provided, which can be adjusted from a neutral position, in which it has no influence on the valuable document transport, into a deflection position, in which it projects into the path of a valuable document transported in one of the sections (33, 39) of the second belt transport unit (5) in the direction of the inner end of the latter and deflects said valuable document by the leading edge into the first belt transport unit (15).

2. The transport device as claimed in claim 1, wherein the rolls (34) and the rolls (40) of the first and second belt transport section (33, 39) are arranged so close beside one another that a valuable document can be transported from one belt transport section (33, 39) into the respective other belt transport section (33, 39).

3. The transport device as claimed in claim 2, wherein, by means of controlling the direction of rotation of the rolls of the second belt transport unit (5) one or more stacks of valuable documents can be formed between the belts of the second belt transport unit (5) and can be moved along the second belt transport unit (5).

4. The transport device as claimed in claim 1, wherein, by means of controlling the direction of rotation of the rolls (28, 30; 36, 34; 40; 42) of the second belt transport unit (5), one or more stacks of valuable documents can be formed between the belts (26, 32, 38) of the second belt transport unit (5) and can be moved along the second belt transport unit (5).

5. The transport device (10) as claimed in claim 1, wherein the roll (16) of the first belt transport unit (15) and the roll (34) of the second belt transport unit (5) are arranged on a common axle (44).

6. The transport device as claimed in claim 1, wherein the first and second belt transport units are arranged in an appliance (58) for paying bank notes in and/or out.

7. The transport device as claimed in claim 6, wherein the appliance (58) for paying in and/or out has a safe (64), the second belt transport unit (5) is arranged outside the safe (64), and the first belt transport unit (15) is led through an opening (70) in the wall of the safe (64).

8. The transport device as claimed in claim 7, wherein the outer end of the first wall of the second section (33, 39) of the second belt transport unit (5) is formed as an input point (62) and/or output point for bank notes.

9. The transport device as claimed in claim 6, wherein the outer end of the first wall of the second section (33, 39)of the second belt transport unit is formed as an input point (62) and/or output point for bank notes.

* * * * *